US007497037B2

(12) United States Patent
Vick et al.

(10) Patent No.: US 7,497,037 B2
(45) Date of Patent: Mar. 3, 2009

(54) LIGHTED FOOTWEAR

(75) Inventors: Douglas M. Vick, Boston, GA (US); Patrick F. Woolley, II, Rockford, MI (US)

(73) Assignee: Boston Ideas, LLC, Thomasvile, GA (US)

( * ) Notice: Subject to any disclaimer, the term of this patent is extended or adjusted under 35 U.S.C. 154(b) by 572 days.

(21) Appl. No.: 11/107,123

(22) Filed: Apr. 15, 2005

(65) Prior Publication Data

US 2006/0230641 A1 Oct. 19, 2006

(51) Int. Cl.
*A43B 23/00* (2006.01)
*F21V 21/08* (2006.01)

(52) U.S. Cl. ..... 36/137; 36/132; 362/103

(58) Field of Classification Search ..... 36/137, 36/122, 103, 132; 362/103, 191, 276, 802
See application file for complete search history.

(56) References Cited

U.S. PATENT DOCUMENTS

| | | | | |
|---|---|---|---|---|
| 3,008,038 | A | 11/1961 | Dickens et al. | |
| 3,067,322 | A | 12/1962 | Sala | |
| 4,324,054 | A | 4/1982 | Rovinsky | |
| 4,848,009 | A | 7/1989 | Rodgers | |
| 5,237,760 | A | 8/1993 | Altman et al. | |
| 5,291,014 | A | 3/1994 | Brede et al. | |
| 5,309,145 | A | 5/1994 | Branch et al. | |
| 5,381,615 | A | 1/1995 | MacMillan | |
| 5,483,759 | A | 1/1996 | Silverman | |
| 5,663,614 | A | 9/1997 | Weng et al. | |
| 5,821,858 | A | 10/1998 | Stone | |
| 5,865,523 | A | 2/1999 | Chien | |
| 6,238,076 | B1 | 5/2001 | Pascale et al. | |
| 6,293,032 | B1 | 9/2001 | Waits | |
| 6,991,342 | B2 | 1/2006 | Gonet | |
| 7,057,153 | B2 | 6/2006 | Linge et al. | |
| 2004/0098884 | A1* | 5/2004 | Swan | 36/137 |
| 2004/0103563 | A1* | 6/2004 | Linge | 36/137 |

OTHER PUBLICATIONS

Seattle Gay News Online Article regarding lighted slippers owned by Steven Dunlap, dated May 22, 2003, 2 pages.
Susan A Thorp, "Dunlap Takes Walk in Dark In Pursuit of Fun Slipper" Memphis Commercial Appeal, Jun. 1989, 2 pages.

* cited by examiner

*Primary Examiner*—Jila M Mohandesi
(74) *Attorney, Agent, or Firm*—Baker Donelson Bearman Cladwell & Berkowitz, PC

(57) ABSTRACT

Footwear is provided that includes a sole having a front and a back. A light source is disposed in the front of the sole. A foot sensor, disposed in the sole, detects the presence or absence of a foot in the footwear. A light sensor, disposed in the sole, is adapted to detect the amount of ambient light adjacent the footwear. The sole may also include a delay circuit for maintaining the light source in the ON state for a predetermined period of time after the foot is removed.

24 Claims, 5 Drawing Sheets

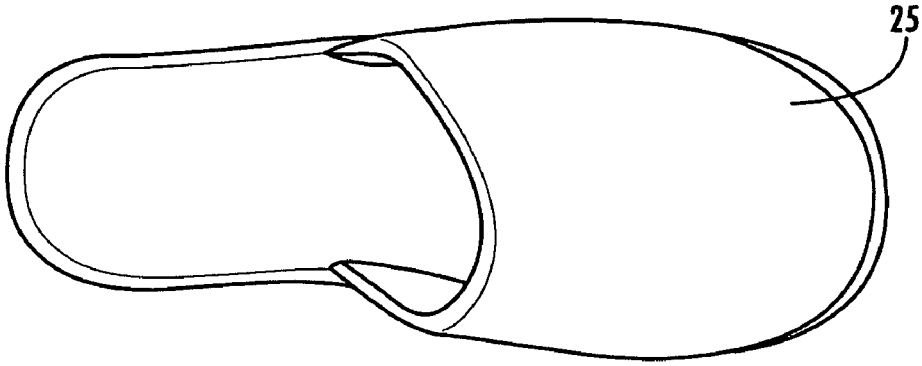
Fig. 6e
Fig. 6f
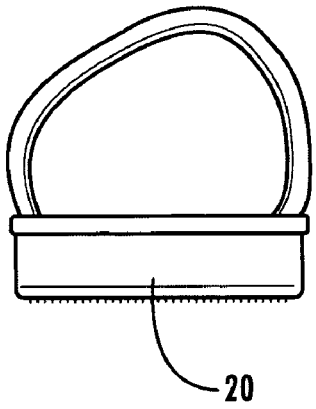
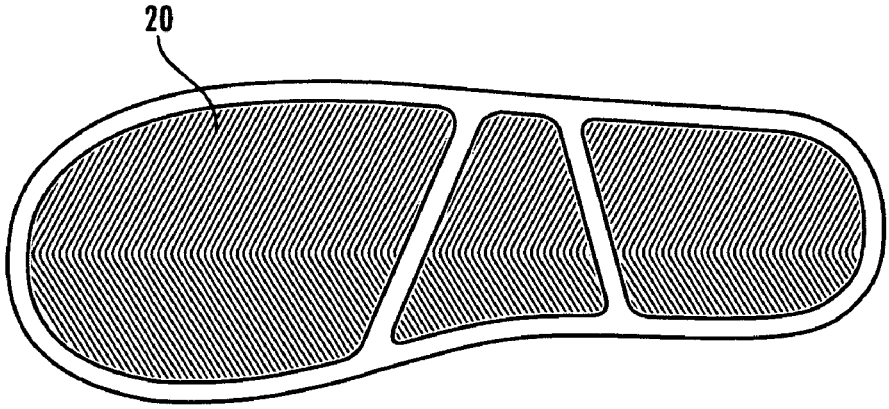
Fig. 6g

LIGHTED FOOTWEAR

FIELD OF THE INVENTION

The technology described in this application relates to footwear, and more particularly to footwear that includes a light source, a light sensor for detecting the amount of ambient light adjacent the footwear and/or circuitry for maintaining the light source in the ON state for a predetermined period of time after a user's foot is removed from the footwear.

BACKGROUND

People must often walk in dark areas, especially at night. Due to the darkness, it is difficult to see objects, such as furniture, toys, balls, etc., in their path. Hitting or tripping over unseen objects can cause injuries. To prevent such injuries, it is desirable to use a light to illuminate the path to be traveled.

It is known to provide a source of illumination on a shoe to overcome the difficulties described above. Some known shoes use a manually operated switch disposed on the exterior of the shoe to control the illumination. Other known shoes include an external heel switch actuated by the pressure of the foot on the floor. In such shoes, the heel switch automatically opens and closes depending on whether the heel is off the floor or on the floor, which results in a flashing shoe light. Still other known shoes include an internal switch that turns a light ON when a foot is in the shoe and turns the light OFF when the foot is removed. See U.S. Pat. No. 3,008,038.

None of the known prior art describes or teaches a construction in which the useful life of a battery controlling a shoe light is extended or how to illuminate an unlighted area once a user's foot is removed from a shoe. Therefore, it is desirable to provide an improved lighted shoe that addresses the deficiencies of the prior art.

It is also desirable to provide footwear, such as a shoe or slipper, that includes a light source and a light sensor adapted to detect the amount of ambient light adjacent the footwear so as to activate the light source only when needed, i.e., when the ambient light is below a predetermined threshold. This extends the battery life of the lighted shoe by disabling the power source when there is sufficient light.

It is desirable to provide footwear that includes a light source and a delay circuit for maintaining the light source in the ON state for a predetermined period of time after the foot is removed, allowing time for the footwear user to maneuver in a lighted path before the light is deactivated.

Thus, a need exists for improved footwear having a lighting construction that enables extended life of the light power source by only activating the light when needed. A need also exists for improved footwear having a lighting construction that provides light even after the foot is removed from the footwear, thereby allowing the wearer time to maneuver before the light is deactivated.

SUMMARY

The footwear described herein overcomes the disadvantages of the prior art by providing lightable footwear that operates control circuitry activated by a switch upon entry of a foot into the footwear to activate a light source when needed in response to detection of ambient light below a threshold and to allow the wearer time to safely maneuver in an illuminated path after removing the footwear. In one aspect, the footwear comprises a sole having a front and a back, with a light source disposed in the front of the sole. A foot sensor disposed in the sole that upon detecting the presence or absence of a foot in the footwear closes a switch to cause a control circuitry to operate and to receive a foot present signal. A light senso, disposed in the sole and, adapted to detect upon operation of the control circuitry the amount of ambient light adjacent the footwear. The control circuitry responsive first to the foot present signal and second to the light sensor maintains the light source in the ON state while the foot sensor detects the presence of a foot in the footwear and while the light sensor detects ambient light below the threshold, and that maintains the light source in the ON state for a predetermined period of time after a foot is removed from the footwear and before the control circuitry ceases operation.

In another aspect, the present invention provides footwear comprising a sole having a front and a back with a light source disposed in the front of the sole, the light source having two states (ON and OFF). A foot sensor disposed in the sole detects the presence or absence of a foot in the footwear, said foot sensor configured for operating a switch to cause a control circuitry to activate. A light sensor disposed in the sole which light sensor upon activation of the control circuitry outputs a signal indicative of the amount of light sensed. Said control circuitry will upon activation determine whether to turn the light source ON by comparing the signal from the light sensor with a threshold ambient light level and maintain the light source in the ON state while the foot sensor detects the presence of a foot in the footwear and maintain the light source in the ON state for a predetermined period of time after a foot is removed from the footwear.

In another aspect, the present invention provides a method of producing footwear comprising the steps of:

(a) providing a sole having a front and a back;

(b) installing a light source in the front of the sole;

(c) installing a foot sensor in the sole;

(d) positioning the foot sensor so that it can detect the presence of a foot in the footwear;

(e) installing a light sensor in the sole that is adapted to detect the amount of ambient light adjacent the footwear; and (f) providing control circuitry configured to operate selectively only upon detection of the presence of the foot in the footwear and to maintain the light source in the ON state while (1) the foot sensor detects the presence of a foot in the footwear and (2) the light sensor detects that the amount of ambient light is below a selected threshold, and to maintain the light source in the ON state for a predetermined period of time after a foot is removed from the footwear.

BRIEF DESCRIPTION OF THE DRAWINGS

FIGS. 6*a-g* show left side, front, right side, perspective, top, back and bottom views, respectively, of one embodiment of the present invention.

DETAILED DESCRIPTION

Figure 1:
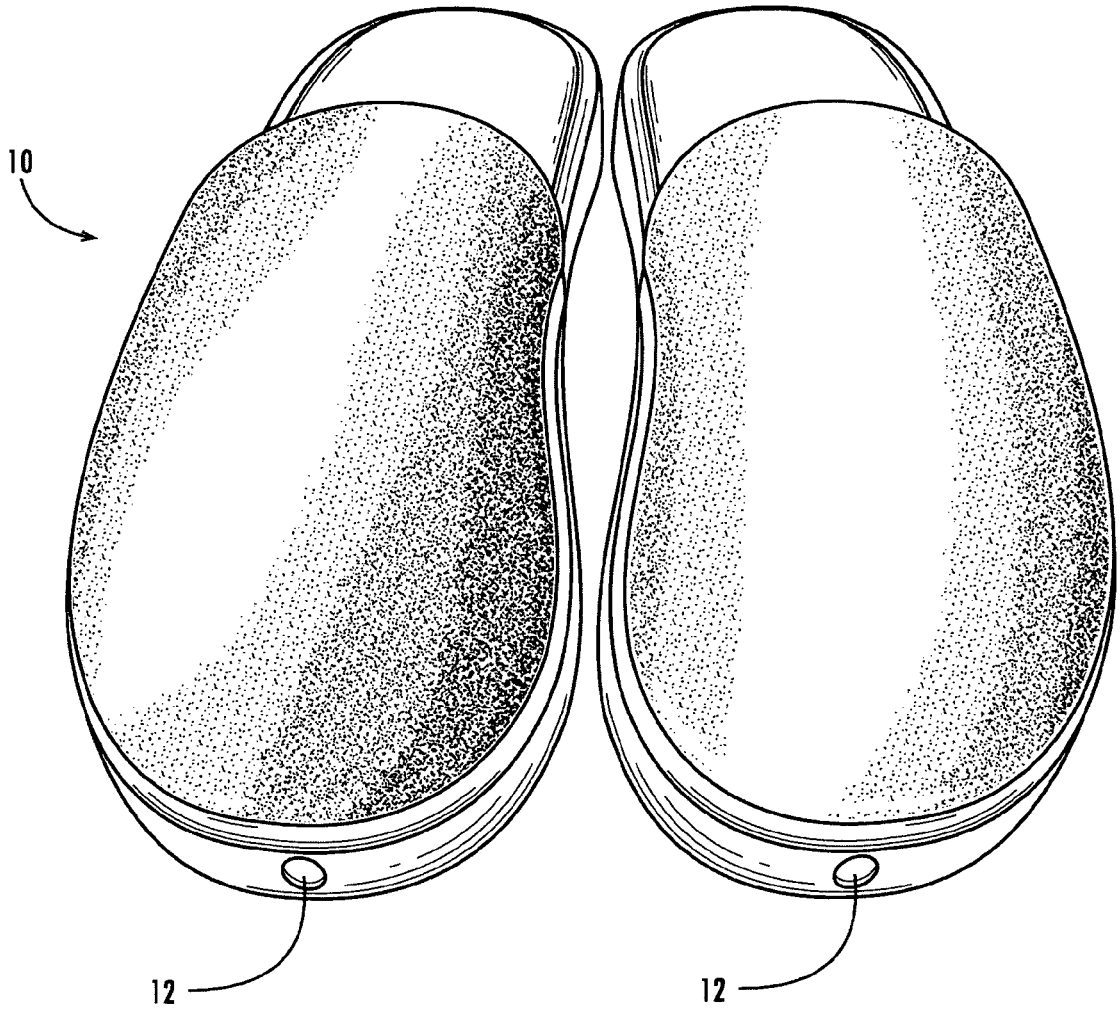
FIG. 1 shows one embodiment of footwear including a light sensor.
Figure 2:
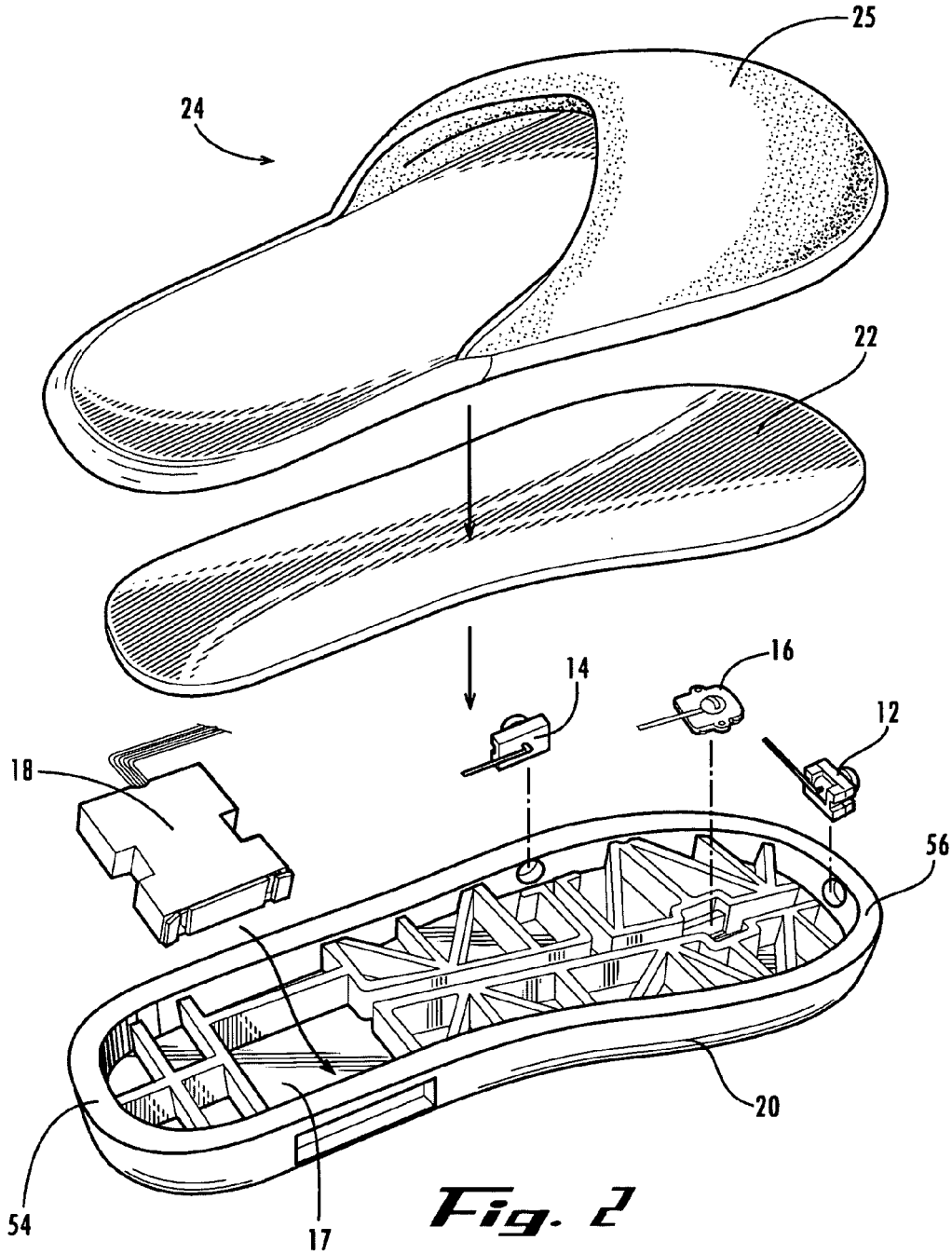
FIG. 2 shows an exploded view of footwear according to one embodiment of the present invention.

The footwear described herein is exemplified by a slipper 10, shown in FIG. 1. However, the claimed invention may be embodied in shoes, sandals, boots, or any other type of footwear. In one embodiment, the slipper 10 includes a sole 20, an insole 22 and a shell 24 that includes a foot covering portion 25, as shown in FIG. 2. In this embodiment, the footwear 10 includes a light source 12, a light sensor 14, a foot sensor 16 and a control mechanism 18. Other embodiments are contemplated that include one or more, but not all, of these elements.

Figure 5:
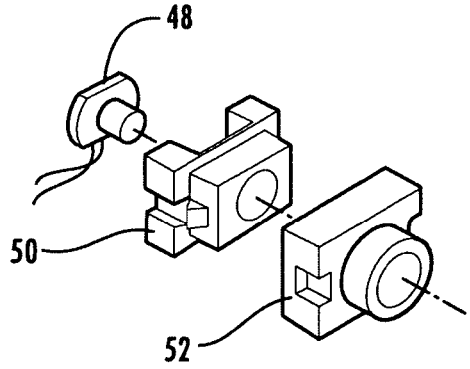
FIG. 5 represents a light source according to one embodiment of the present invention.
Figure 6A:
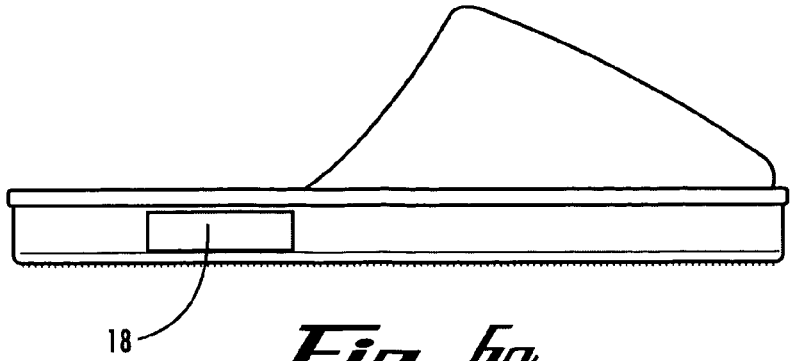
Figure 6B:
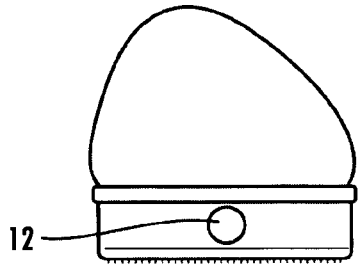
Figure 6C:
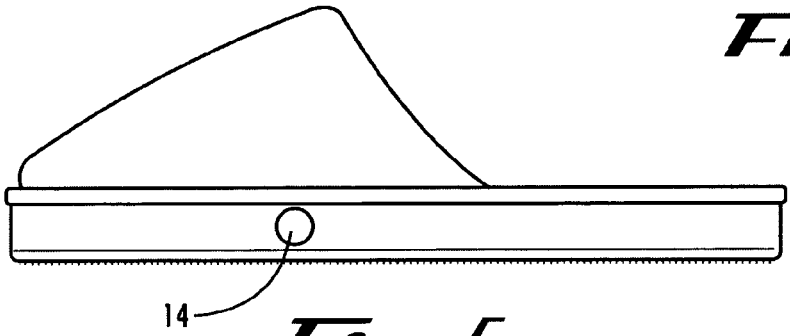
Figure 6D:
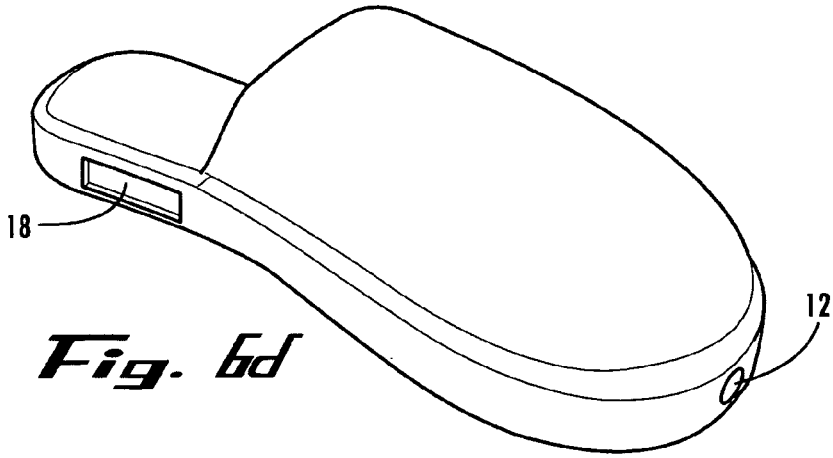

The sole 20 is formed of foam, rubber, plastic or any other suitable material. A light source 12 is mounted in the front portion or toe 56 of the sole 20. The toe 56 includes an aperture that allows light from the light source 12 to shine in front of the footwear 10. In one embodiment, the light source 12 is tilted upward (e.g., at an angle of about 30 degrees with respect to a horizontal plane that intersects the sole) for optimum projection of light. The beam of light extends ahead of the slipper 10 to illuminate the area in front of the slipper 10 so the wearer can safely navigate at night and/or in the dark. The light source 12 has two states (ON and OFF). In one embodiment, the light source 12 is manufactured by M.L.S. ELECTRONICS CO. (model number MCP12) and includes a light emitting diode (LED) 48 (model number PK100), an LED holder 50 (model number PK101A) and an LED lens 52 (model number PK102A), as shown in FIG. 5.

Figure 3:
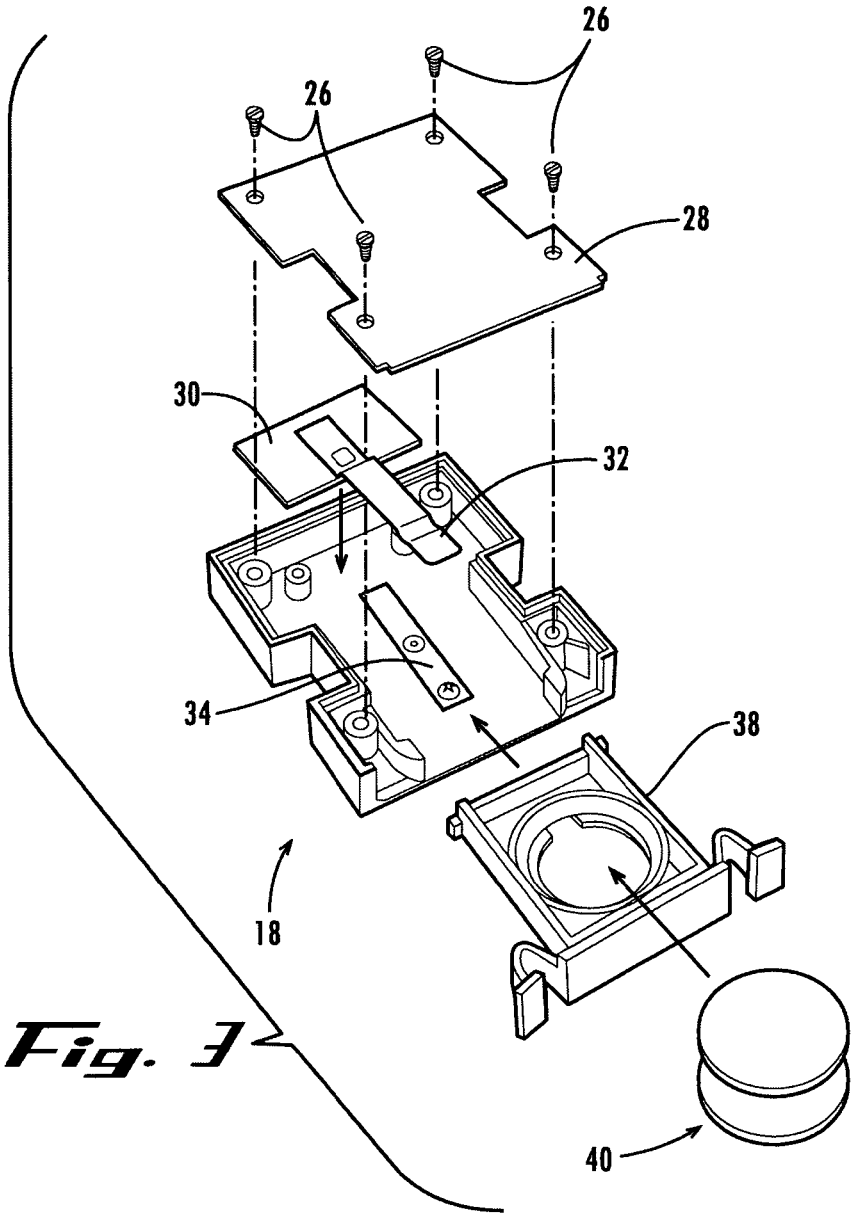
FIG. 3 represents a power source and enclosure according to one embodiment of the present invention.

The sole 20 includes a cavity 17 (preferably disposed in the back portion or heel 54) for housing the control mechanism 18. In one embodiment, the control mechanism 18 is manufactured by EASTAR INDUSTRIES LIMITED (model number MCP10) and includes a power source 40 and control circuitry 30 (model number ES33), as shown in FIG. 3. The control mechanism 18 has a cover 28 that is secured to an enclosure base 29 by screws 26. Contact plates 32 and 34 couple the electrical energy from the power source 40 to the control circuitry 30. One or more wires then couple the electrical energy from the power source 40 to the light source 12, light sensor 14 and/or foot sensor 16. In one embodiment, the power source 40 is a pair of lithium batteries (model number MC212N) that are disposed in a battery holder 38 (model number MC15), both models being manufactured by EASTAR INDUSTRIES LIMITED. In one embodiment, the control mechanism 18 further includes protection circuitry (e.g., a circuit breaker or fuse) that prevents damage to the electronics due to improper insertion of the batteries 40.

The foot sensor 16, mounted in the sole 20, outputs a control signal indicating whether a foot is present or not in the footwear 10. In one embodiment, the output of the foot sensor 16 is coupled to the light source 12. The control signal activates the light source 12 in response to a foot being inserted into the footwear and deactivates it after the foot is removed. In one embodiment, the foot sensor 16 is a contact switch (model number ES6014) manufactured by EASTAR INDUSTRIES LIMITED. Preferably, the switch is disposed in an area of the sole 20 where the foot of a user of the footwear makes good contact with the sole (e.g., under the heel, the ball of the foot or the toes). Alternatively, the foot sensor may include any type of sensor capable of sensing the presence or absence of a foot in the footwear, including a pressure sensor, optical sensor, weight sensor, inductance sensor, capacitance sensor, and the like.

In another embodiment, the control signal from the foot sensor 16 is coupled to control circuitry 30. In this embodiment, control circuitry 30 (model number ES33) includes an integrated circuit (model number ES6115) and a capacitor (model number ES442) manufactured by EASTAR INDUSTRIES LIMITED. However, the control circuitry 30 may include any suitable circuitry, such as an ASIC, a microprocessor, a circuit board, a battery, and the like. Control circuitry 30 determines when to turn the light source ON and OFF given the control signal from the foot sensor 16. Control circuitry 30 then actuates the light source (turns it ON and OFF) accordingly. For example, the control circuitry 30 may delay turning OFF the light source for a predetermined period of time (e.g., 6 seconds) after the foot is removed, allowing the wearer time to safely navigate in a lighted path after removing the footwear.

Figure 4:
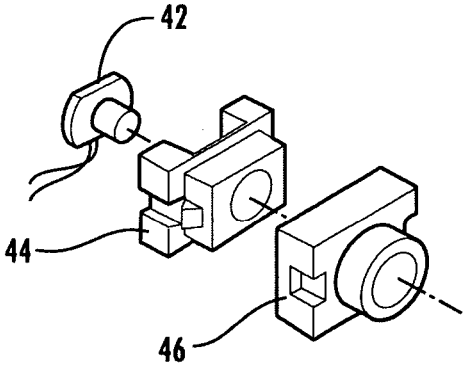
FIG. 4 represents a light sensor according to one embodiment of the present invention.

In a further embodiment, a light sensor 14 is mounted in the sole adjacent an aperture that allows the light sensor 14 to detect the amount of light adjacent the footwear 10, as shown in FIG. 2. In one embodiment, the light sensor 14 is manufactured by SEN TECH COMPANY LIMITED (BRAND: KRC) (model number KR16) and includes a Cadmium Sulfide (CdS) sensor 42 (model number STC551), a sensor holder 44 (model number WT1) and a sensor lens 46 (model number WT2), as shown in FIG. 4. The light sensor 14 outputs a signal indicative of the amount of light sensed. In this embodiment, the output of the light sensor 14 is coupled to control circuitry 30. Control circuitry 30 determines whether to turn the light source ON when a foot is inserted into the footwear by comparing a signal indicative of the amount of light sensed with a threshold. When the sensed light is above the threshold, the light source is disabled (whether a foot is present in the footwear or not). When the sensed light is below the threshold, the light source is activated when a foot is inserted into the footwear. In this way, the battery life of the footwear is extended by not activating the light source when it is not needed, i.e., when there is sufficient ambient light adjacent the footwear.

FIGS. 6*a-g* show left side, front, right side, perspective, top, back and bottom views, respectively, of the footwear 10 according to one embodiment of the invention.

The above described lighted footwear 10 provides several advantages over known footwear, including activating a light source only when needed, extending battery life, and allowing time for the wearer of the footwear to safely maneuver in an illuminated path after removing the footwear.

The lighted footwear 10 allows the wearer to safely navigate dark areas, which substantially decreases the possibility of injury due to unseen objects. The extended battery life means that the footwear will provide safe illumination longer than previously known lighted shoes. Also, providing footwear that illuminates a path even after the foot is removed provides additional safety over known lighted shoes that turn OFF once the foot is removed.

While particular embodiments of the invention have been shown and described in detail, it will be obvious to those skilled in the art that changes and modifications of the present invention, in its various embodiments, may be made without departing from the spirit and scope of the invention. Other elements, steps, methods and techniques that are insubstantially different from those described herein are also within the scope of the invention. Thus, the scope of the invention should not be limited by the particular embodiments described herein but should be defined by the appended claims and equivalents thereof.

The invention claimed is:

1. Footwear comprising:

a sole having a front and a back;

a light source disposed in the front of the sole;

a foot sensor disposed in the sole that upon detecting the presence of a foot in the footwear operates a switch to cause a control circuitry to activate and to receive a foot present signal;

a light sensor disposed in the sole and adapted to detect, upon activation of the control circuitry, the amount of ambient light adjacent the footwear; and said control circuitry that is responsive first to the foot present signal and second to the light sensor maintains the light source in the ON state while the foot sensor detects the presence of a foot in the footwear and while the light sensor detects ambient light below a threshold light level, and that maintains the light source in the ON state for a predetermined period of time after a foot is removed from the footwear and before the control circuitry ceases operation.

2. The footwear of claim 1 wherein the light source has two states (ON and OFF).

3. The footwear of claim 2 further including a delay circuit for maintaining the light source in the ON state for a predetermined period of time.

4. The footwear of claim 1 wherein the light source comprises an LED.

5. The footwear of claim 1 wherein the light source is disposed at an angle of about 30 degrees with respect to a horizontal plane that intersects the sole.

6. The footwear of claim 1 wherein the foot sensor is selected from the group consisting of a contact switch, a pressure sensor, an optical sensor, a weight sensor, an inductance sensor and a capacitance sensor.

7. The footwear of claim 1 further including a power source.

8. The footwear of claim 7 wherein the power source comprises one or more lithium batteries.

9. The footwear of claim 8 further including protection circuitry that prevents damage to electronics due to improper insertion of the one or more batteries.

10. The footwear of claim 7 wherein the power source supplies power to the light source.

11. The footwear of claim 1 wherein the foot sensor outputs a signal indicating whether a foot is present or not in the footwear.

12. The footwear of claim 11 further including control circuitry for determining when to turn the light source ON and OFF based on the signal from the foot sensor.

13. The footwear of claim 1 wherein the light sensor outputs a signal indicative of the amount of light sensed.

14. The footwear of claim 13 wherein upon operation of the control circuitry, the control circuitry determines whether to turn the light source ON by comparing the signal from the light sensor with the threshold ambient light level.

15. The footwear of claim 14 wherein the control circuitry activates the light source only when a foot is inserted into the footwear and the sensed light is below the threshold level.

16. The footwear of claim 1 wherein the footwear is selected from the group consisting of a slipper, a shoe, a sandal, and a boot.

17. A method of producing footwear comprising the steps of:

(a) providing a sole having a front and a back;

(b) installing a light source in the front of the sole;

(c) installing a foot sensor in the sole;

(d) positioning the foot sensor so that it can detect the presence of a foot in the footwear;

(e) installing a light sensor in the sole that is adapted to detect the amount of ambient light adjacent the footwear; and (f) providing control circuitry configured to operate selectively only upon detection of the presence of the foot in the footwear and to maintain the light source in the ON state while (1) the foot sensor detects the presence of a foot in the footwear and (2) the light sensor detects that the amount of ambient light is below a selected threshold, and to maintain the light source in the ON state for a predetermined period of time after a foot is removed from the footwear.

18. The method of claim 17 wherein the light source has two states (ON and OFF).

19. The method of claim 18 further comprising installing a delay circuit in the footwear that maintains the light source in the ON state for a predetermined period of time after activation.

20. The method of claim 17 wherein the light source comprises an LED.

21. The method of claim 17 further comprising positioning the light source at an angle of about 30 degrees with respect to a horizontal plane that intersects the sole.

22. The method of claim 17 wherein the foot sensor is selected from the group consisting of a switch, a contact switch, a pressure sensor, an optical sensor, a weight sensor, an inductance sensor, and a capacitance sensor.

23. Footwear comprising:

a sole having a front and a back;

a light source disposed in the front of the sole, the light source having two states (ON and OFF);

a foot sensor disposed in the sole that detects the presence or absence of a foot in the footwear, said foot sensor configured for operating a switch to cause a control circuitry to activate;

a light sensor disposed in the sole which light sensor upon activation of the control circuitry outputs a signal indicative of the amount of light sensed; and said control circuitry will upon activation determine whether to turn the light source ON by comparing the signal from the light sensor with a threshold ambient light level and maintain the light source in the ON state while the foot sensor detects the presence of a foot in the footwear and maintain the light source in the ON state for a predetermined period of time after a foot is removed from the footwear.

24. The footwear of claim 23 wherein the control circuitry activates the light source only when a foot is first inserted into the footwear in order to cause the control circuitry to operate and the sensed light is below the threshold level.

* * * * *